US012409361B2

(12) United States Patent
Watson

(10) Patent No.: US 12,409,361 B2
(45) Date of Patent: Sep. 9, 2025

(54) LOW-PROFILE BALANCE BOARD

(71) Applicant: Richard Yates Watson, Park Ridge, IL (US)

(72) Inventor: Richard Yates Watson, Park Ridge, IL (US)

( * ) Notice: Subject to any disclaimer, the term of this patent is extended or adjusted under 35 U.S.C. 154(b) by 111 days.

(21) Appl. No.: 18/387,000

(22) Filed: Nov. 3, 2023

(65) Prior Publication Data

US 2024/0325817 A1 Oct. 3, 2024

Related U.S. Application Data

(60) Provisional application No. 63/492,504, filed on Mar. 28, 2023.

(51) Int. Cl.
*A63B 22/16* (2006.01)
*A63B 71/00* (2006.01)

(52) U.S. Cl.
CPC ..... *A63B 22/16* (2013.01); *A63B 71/0054* (2013.01)

(58) Field of Classification Search
CPC ..... A63B 22/14; A63B 22/16; A63B 22/18
See application file for complete search history.

(56) References Cited

U.S. PATENT DOCUMENTS 2,947,009 A * 8/1960 Mckenzie ..... A47C 21/00 359/872
3,488,049 A * 1/1970 Sasser, Jr. ..... A63B 22/16 482/146
3,561,022 A * 2/1971 James ..... A61H 1/0229 482/142
4,822,039 A * 4/1989 Gonzales ..... A63B 21/04 482/130
5,328,421 A * 7/1994 Stanalajczo ..... A63B 22/16 482/79
5,755,651 A * 5/1998 Homyonfer ..... A63B 22/16 482/130
7,252,290 B1 * 8/2007 Kaselitz ..... A63B 26/003 273/449
8,888,669 B2 * 11/2014 Dunegan ..... A63B 23/1236 482/141
11,369,839 B2 * 6/2022 Mrzlak ..... A63B 21/4034

FOREIGN PATENT DOCUMENTS

KR 20230116403 A * 8/2023

* cited by examiner

*Primary Examiner* — Zachary T Moore

(57) ABSTRACT

A balance board comprising a board, a first member, and a pivot interface. The board has a top side for applying active use resistance and active use effort, a bottom side, and an outer circumference. The first member consists of a base, a first side, a second side, and a pivot, the base having a width and the pivot having a second width, the first width greater than the second width. The first pivot interface comprises a roll section of the pivot and a first section of the bottom side of the board. The board and the first member have a low-height profile and a restricted roll in response to an active use resistance and an active use effort applied to the top side of the board. The pivot is rounded convex or bullnose shape. The base has a width 5 times greater than the width of the pivot's base.

18 Claims, 4 Drawing Sheets

LOW-PROFILE BALANCE BOARD

CROSS-REFERENCE TO RELATED APPLICATION

This application claims priority to U.S. Provisional Application No. 63/492,504, filed Mar. 28, 2023, the contents of which are incorporated herein by reference.

BACKGROUND

The present disclosure relates to physical fitness equipment and, more particularly, balancing boards for improving balance or equilibrium, and safety measures for the elderly or inform.

Aging brings about physiological changes that affect the body in various ways. These changes can cause bones to shrink in size and density, muscles to lose mass, strength, and flexibility, and the cognitive abilities of the brain to functionally diminish. These are factors that can affect a person's balance, stability, and coordination. Diminished balance, instability, and poor coordination are conditions that increase the chances of a person falling and injuring themselves. In some cases, these injuries can result in fractures, head trauma, and even death. According to www.nidcd.nih.gov website, falls are a leading cause of injury among older adults.

Exercises performed using a balance board can be effective at countering diminished balance coordination. Using a balance board can improve balance and coordination, develop posture and core strength, rehabilitate, and prevent injuries, increase motor skills and cognitive skills, and strengthen lower leg muscles. Balance boards available on the market may be effective for their intended purpose, but all lack critical safety features. As a result, exercising using one of these available balance boards can result in injury or injuries. And for the elderly, or those otherwise considered infirm, these types of injuries can be serious or even life threatening.

As can be seen, there is a need for a balance board with improved safety measures.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present disclosure.

Figure 1:
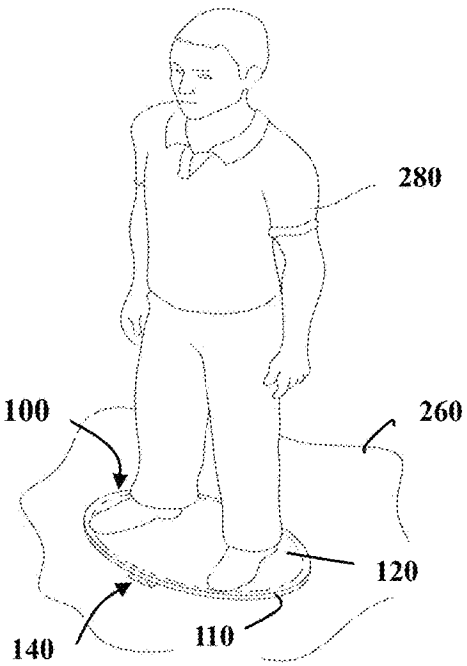
FIG. 1 shows a top perspective view of a person using a low-profile balance board, the balance board comprising a board and one of a plurality of wedges for use with the board.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized, and structural and functional modifications may be made, without departing from the scope of the present disclosure.

Overview

As previously stated, the aging process brings about physiological changes to the body. As a result, a person's reflexes and reaction time tend to slow down.

Falls among the elderly are a serious health issue that can cause injuries, death, and reduced quality of life. The risk of falling increases with age due to physical changes, health conditions, medications, environmental hazards, and other factors. According to the Centers for Disease Control and Prevention (CDC), one in four older adults reported falling, which equals about 36 million falls. Many of these falls require medical attention or a limitation in activity. It is also known that the risk of fall-related injuries and death increases with the height from which one falls. Additionally, the CDC has stated that more than 32,000 adults die from falls each year, or 88 adults per day. Injuries from falls and the fear of falling are a threat to the health and independence of older adults.

It is important to take preventive measures to avoid falls among the elderly. Routine physical exercises are a great preventive measure. As previously stated, balance boards are great at countering diminished balance coordination. However, balance boards currently available on the market are dangerous when used ineffectively or not used properly or used carelessly. They can be particularly dangerous for the elderly, or infirm, who do not have the necessary reflexes and reaction time to use one of the commercially available balance boards as needed to benefit without significant risk of injury or death. As such, the elderly are much less likely to benefit from the benefits of this type of physical exercise device.

Balance boards currently on the market have a platform (or board) set on top of, or coupled with, a pivot member. The balance board is set on ground surface and a person attempts to balances themselves and the platform as the pivot member rotates along the ground surface. The pivot member is configured to have a pivot with a large, rounded area that rolls along ground surface.

A particular problem is that the platform sets too high from the ground, or stable surface. The platforms for some balance boards at level, or non-rotated, are over three and a quarter inch from the ground, and most are over five inches from the ground. Moreover, one of the body's ways to have awareness in balance is by proprioceptors. These sensory receptors are found in muscles, tendons and joints throughout the body. This low-profile board can achieve results in improved balance without the height problem of other balance boards.

Another problem with currently available balance boards is the slow roll due to the large, rounded area of the pivot member. These are factors that can increase the chance of injury. The combination of height, slow roll, and size of the person can cause sudden changes in rotational velocity and motion. The higher the balance board is off the ground, the more pronounced the changes. Although for most these changes may not be disruptive, or even noticeable, to the elderly, or infirm, these sudden changes can be unmanageable and result in injury.

Presented herein is a low-profile balance board having dimensioned safety measures that reduce the chance of injury while using the balance board. The low-profile balance board comprises a board, a first member, and a first pivot interface. The board has a top side for applying active use resistance and active use effort, a bottom side, and an outer circumference. The first member consists of a base, a first side, a second side, and a pivot. The first pivot interface comprises a top section of the pivot and a first section of the bottom side of the board. The board comprises a traverse (or horizontal) plane. The traverse (or horizontal) plane runs lengthwise to the board and has a fast roll, but a restricted roll due to a low-height profile that keeps the board stable and low to the ground.

Also, presented herein is an article of manufacture comprising a board, a first member, and one or more additional members. The board comprises a top side for applying an active use resistance and an active use effort, a bottom side, and an outer circumference. The first member consists of a base, a first side, a second side, and a pivot between the first side and the second side. Each additional member consists of a base, a first side, a second side, and a pivot. The base, the first side, the second side, the pivot, or any combination thereof of each additional member has one or more dimensions distinct from the first member and other additional members. The article of manufacture further includes a first pivot interface. The first pivot interface further comprises a top section of the pivot and a first section of the bottom side of the board. The board comprises a traverse (or horizontal) plane. The traverse (or horizontal) plane runs lengthwise to the board and has a fast roll, but a restricted roll due to a low-height profile that keeps the board stable and low to the ground.

Additionally, presented herein is a balance board comprising a board, a first member, and a first pivot interface. The board has a top side for applying active use resistance and an active use effort, a bottom side, and an outer circumference. The first member consists of a base, a first side, a second side, and a pivot between the first side and the second side. The base has a first width, and the pivot has a second width, the first width greater than the second width. The first pivot interface comprises a roll section (FIG. 2B) of the pivot and a first section of the bottom side of the board. The board and the first member have a low-height profile and a restricted roll in response to an active use resistance and an active use effort applied to the top side of the board.

The first pivot interface comprises a surface, non-fixed contact. The balance board further comprises a second pivot interface, the second pivot interface comprising the top section of the pivot and a second section of the bottom side of the board, the second pivot interfaced achieved in response to movement (or swing or tipping) active resistance, movement (or swing or tipping) active effort, or both. The pivot (FIG. 2B) is rounded convex or bullnose shape. The base has a width 5 times greater than the width of the pivot's base. The first side and the second side have an angle of incline of 45 degrees. The balance board comprises a second member with two sides and a pivot, the second member having one or more dimensions different than the first member. The balance board further comprises one or more additional members with each having two sides and a pivot, the one or more additional members having one or more dimensions different than the first member and the second member.

The low-profile balance board has many advantages over commercially available balance boards. The low-profile balance board has a board (or platform) and multiple (balancing) members of various sizes, e.g., large, medium, and small. The board proportionally has a much greater dimensional area than that of each member. The largest member has a total height under 1.5 inches, (unless this includes the board, which is then 2.0 inches). Each member includes a pivot with a rounded, smooth convex shape, a flat base that rests flat or parallel with a ground surface, and two inclined sides between the flat base and pivot, or base sides of the pivot. Additionally, the board and the member are in surface contact and not physically connected or fixed together, allowing the board to be easily manipulated during use.

The unique oval size of the board gives the user the perception of being closer to the ground and the total height allows the board to be closer to the ground. Each of these can help the user stay focused and avoid injury. The rounded, smooth convex shape allows the board to easily roll and to do so without frictional forces disrupting the roll. Additionally, the rounded, smooth convex shape allows the board to be easily manipulated, e.g., to change positions of the board with respect to the member, while using the low-profile balance board. Further, the flat base, height, or both eliminate or minimizes the member from responding to rotational force or torque about its axis. Furthermore, the total height and rounded, smooth convex shape allows the board to have a fast roll, realistic simulated balance training situation, for an optimal workout.

The low-profile balance board can be made of wood, metal, plastic, or any combination thereof. Members of low-profile balance board can be manufactured as a single piece member or a multipiece member.

Description

FIG. 1 illustrates a top perspective view of person 280 using a low-profile balance board 100, according to certain aspects of the present disclosure. Low-profile balance board 100 comprises a board 110, top side 120 with outer circumference, (balancing) member 140, and ground surface 260.

In use, person 280 places member 140 under board 110 at a desired location. While holding on to a non-movable object for additional safety, person 280 steps on low-profile balance board 100 and begins applying an active use resistance and an active use effort to balance themselves and board 110 on member 140. Person 280, while standing on board 110, can change positions of board 110 with respect to member 140 to target a particular muscle group.

Figure 2A:
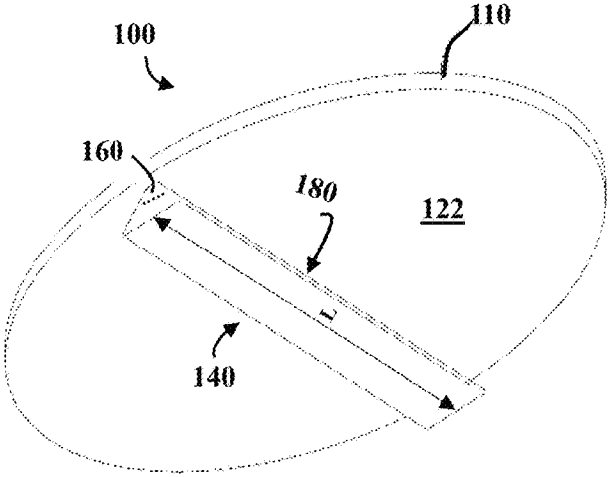
FIG. 2A shows a bottom perspective view of the low-profile balance board.
Figure 3:
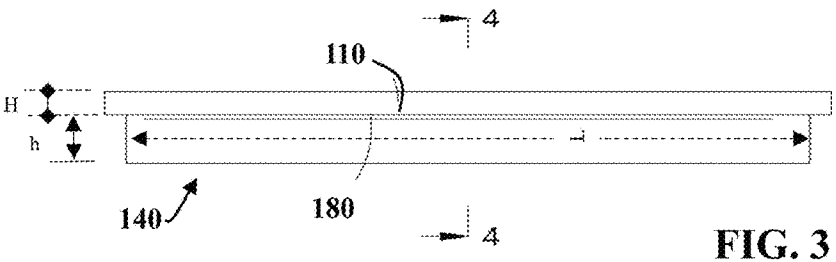
FIG. 3 is a side view of the low-profile balance board.
Figure 2B:
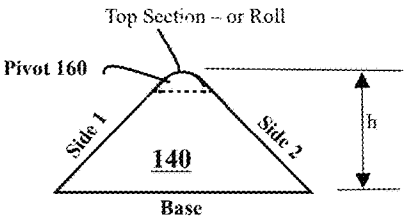
FIG. 2B shows a side view of wedge or member for use with a low-profile balance board.
Figure 4:
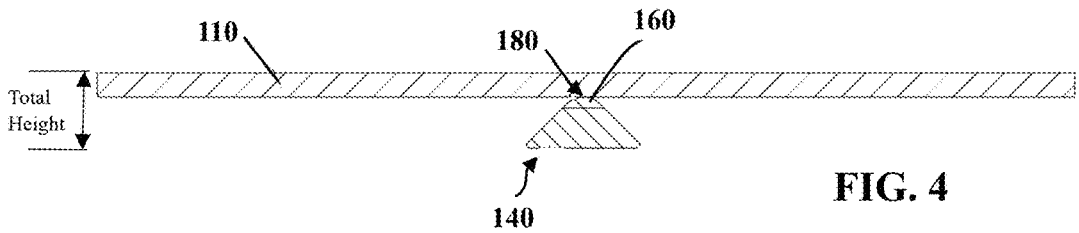
FIG. 4 is a section view of the low-profile balance board, taken along line 4-4 in FIG. 3.

FIGS. 2A and 2B illustrate a perspective view of a bottom side 122 of the low-profile balance board 100, and a bottom-side view of member 140, respectively, according to certain aspects of the present disclosure. Low-profile balance board 100 comprises board-pivot interface 180. Board-pivot interface 180 comprises a top section (or roll area) of pivot 160 and a section of bottom side 122. FIG. 3 illustrates a side view of low-profile balance board 100, according to certain aspects of the present disclosure. FIG. 4 illustrates a section view of low-profile balance board 100, taken along line 4-4 in FIG. 3, according to certain aspects of the present disclosure.

In general, board 110 has a greater dimensional area than that of each member. As an example, board 110 can measure over 2 feet in length and a foot and a half in width. More particularly, board 110 can have a circumference of about 68 inches, a length of about 25 and ¾ inches, a width of about 17 inches, and a height (H) of about ¾ of an inch. Member 140 can have a base width of about 2 inches, length of about 12 inches, a height (h) of about 1 and a ½ inches. Additionally, sides 1 and 2 can have a width of about 2 inches and an incline of about 45 degrees. The total height of low-profile balance board 100 in its level position is about 2 and ¼ inches. The total height of low-profile balance board 100 at its top roll height is about 3 and ¾ inches.

Figure 5A:
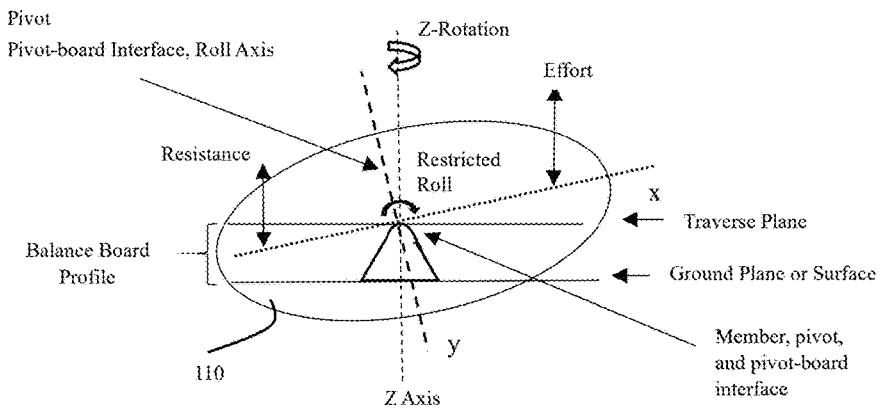
FIG. 5A is a schematic diagram of the low-profile balance board.
Figure 5B:
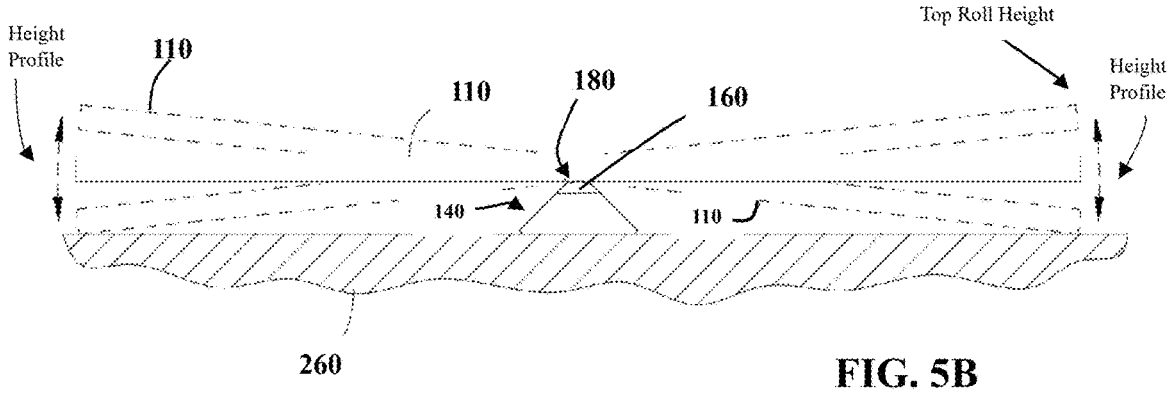
FIG. 5B is a front view of the low-profile balance board showing the movement (or swing or tipping) of the board on its pivot.

FIG. 5A is a diagrammatic side view representation of low-profile balance board 100, according to certain aspects of the present disclosure. FIG. 5B is a front view of low-profile balance board 100 showing the movement (or swing or tipping) of board 110 on its pivot 160, according to certain aspects of the present disclosure.

Pivot 160 can have a rounded or curved type smooth top surface. Pivot 160 can be a smooth, convex type layer or surface of pivot 160. Pivot 160 can be described as a smooth, full bullnose type layer or surface of pivot 160. The bullnose type layer or surface of pivot 160 and its dimensions with respect to board 110 allow pivot 160 to have a fast roll. The roll is restricted due to the height of the member 140. The smoothness of the top surface of pivot 160 improves durability and reduces drag, allowing board 110 to glide or move more easily under load and create a realistic simulated balance training situation.

Base of member 140 is relatively wide with respect to pivot 160. This eliminates or minimizes member 140 from responding to rotational force or torque about its axes. This is a safety measure that keeps the traverse plane of board 110 relatively fixed with the ground plane of member 140 during use. This allows person 280 to concentrate on balancing board 110 and not on balancing and the rolling action of some commercially available products that use a cylinder, half-circle shape, or something similar, in place of member 140.

Figure 6:
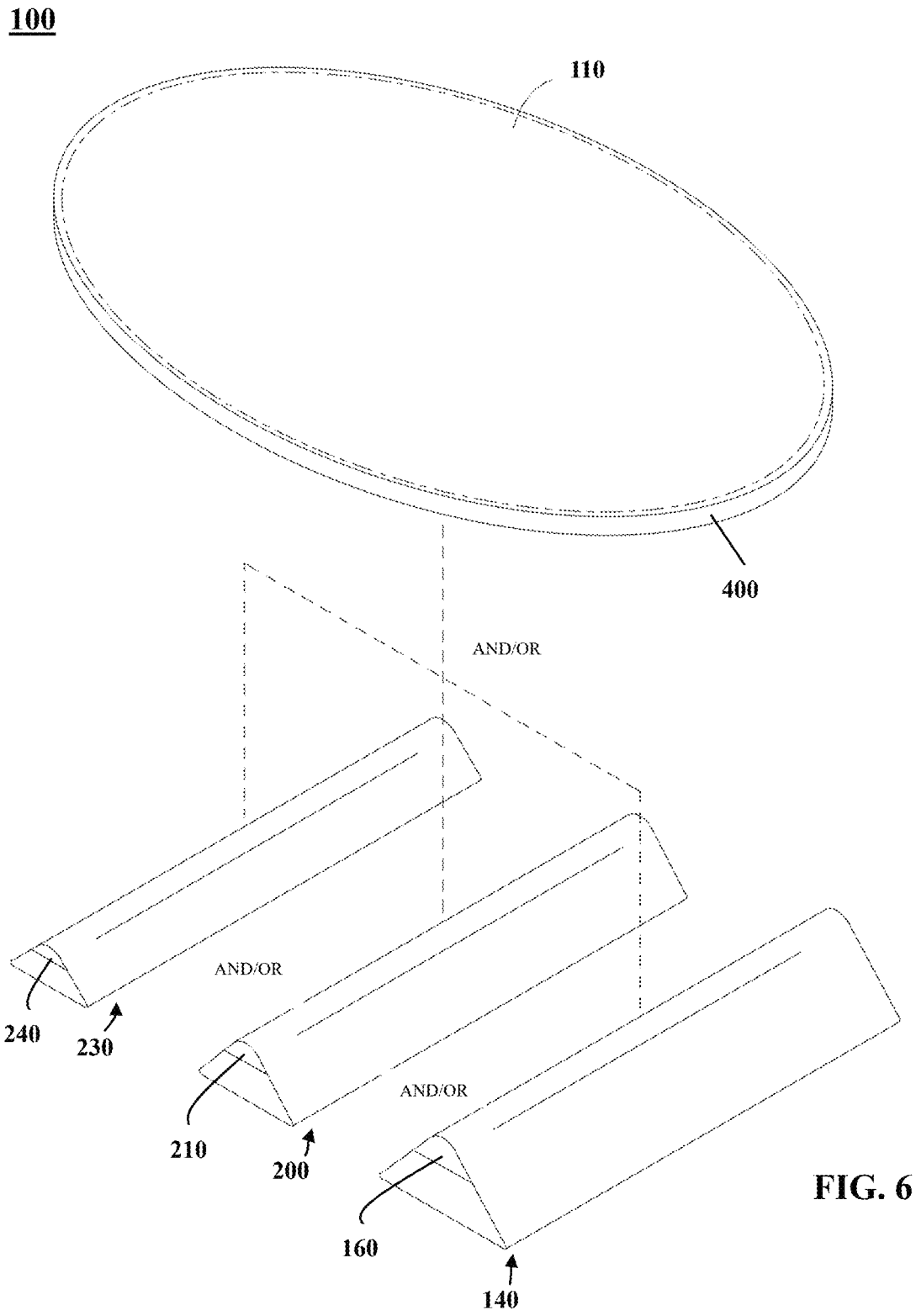
FIG. 6 is an exploded view of the invention, illustrating the ability to interchangeably use variably sized wedges.
Figure 7:
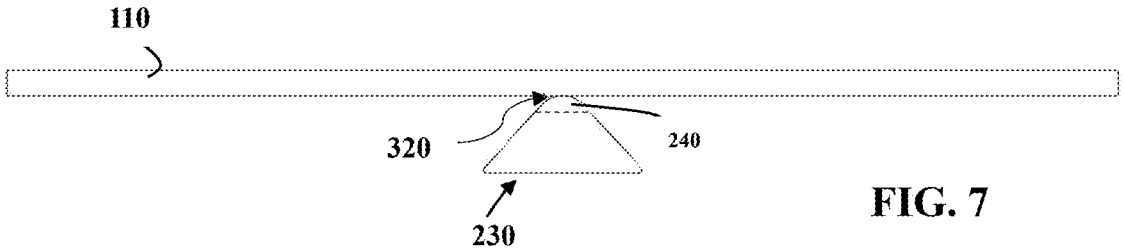
FIG. 7 is a front view of the low-profile balance board, shown with a small wedge of select dimensions.
Figure 8:
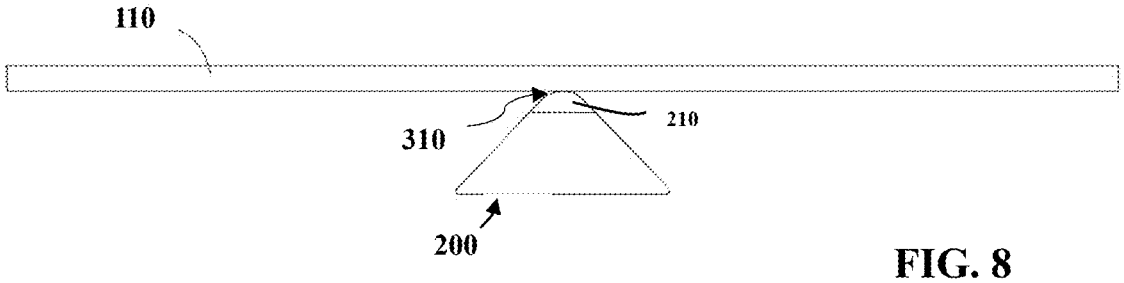
FIG. 8 is a front view of the low-profile balance board, shown with a medium wedge of other select dimensions.

FIG. 6 is an exploded view of board 110 and first (large) member 140 with pivot 160, member 140 having a first set of dimensions, second (medium) member 200 with pivot 210, member 200 having a second set of dimensions, and third (small) member 230 with pivot 240, member 230 having a third set of dimensions, according to some aspects of the present disclosure. FIG. 7 is a front view of low-profile balance board 100, shown with board 110, member 230 of select dimensions, and board-pivot interface 320, according to some aspects of the present disclosure. FIG. 8 is a front view of low-profile balance board 100, shown with board 110, member 200 of other select dimensions, and board-pivot interface 310, according to some aspects of the present disclosure.

Board 110 can be manufactured to have an oval or oblong shape. Although other shapes are possible, the oval or oblong shape can provide sufficient lateral space that may be preferred for some users over a shape that has less lateral space. Board 110 can measure over 2 feet in length, a foot and a ½ in width. Although other sizes are possible. During use, the size and shape of board 110 can give the user the impression board 110 is closer to the ground or that he or she is standing on a more robust or solid platform. For the elderly, this can help with relation, or perspective, and allow the user to focus on the task at hand. It also allows the user to find the stance that is most comfortable in performing an exercise routine, which also helps with relaxation. As previously provided, board 110 and member 140 have dimensions selected to improve balance board safety while using the device for exercise routines, without compromising the quality and effectiveness of these routines.

As previously stated, member 140 can have a base width of about 2 and ½ inches, length of about 12 inches, and a height (h) of about 1 and a ½ inches. Member 200 is slightly shorter than member 140 at a little over an inch in height (h). Member 230 is slightly shorter than member 200 at around ¾ of an inch in height (h). A novice or someone not in good balance condition or physical fitness shape can start out using the smallest member, 230, and work their way up to member 140, the largest member. This wedge or member progression is important for variety and balance improvements.

Board 110 and member 140 are not physically attached together or fixed to one another. Board 110 and member 140 have a surface, non-fixed contact. This allows the user to manipulate board 110 to various positions while using it to adjust an exercise routine to target other muscle groups.

Figure 9:
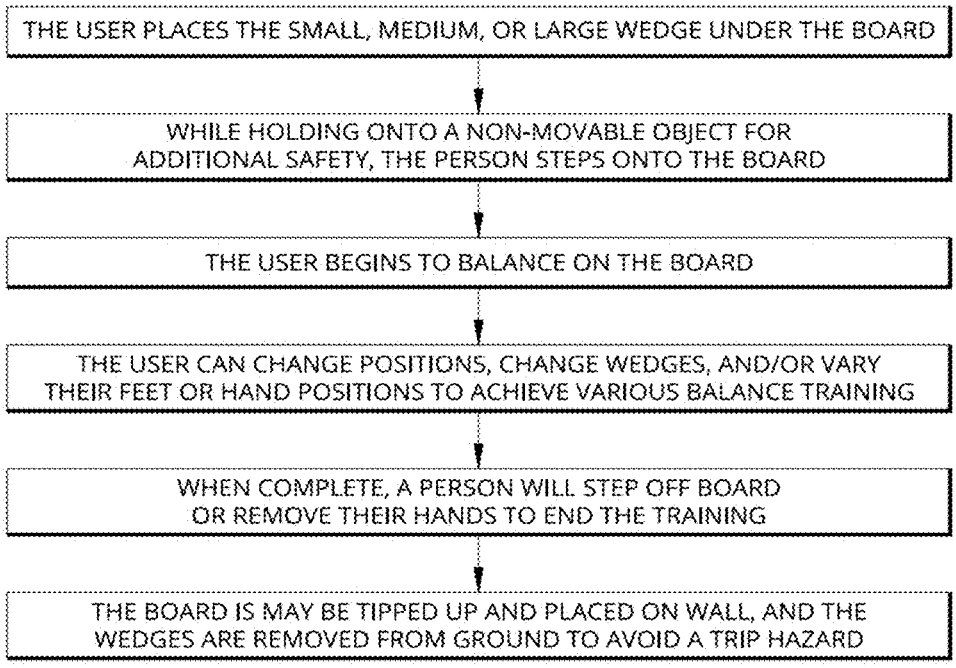
FIG. 9 is a flow chart of a typical order of steps a person might follow when using the low-profile balance board.

In use, see FIG. 9, person 280 can select from members 140, 200, and 230, depending on the user's experience level. For a novice, member 230 (level 1) can be used. For an experienced user, member 140 (level 3) can be used. The selected member is placed under board 110 at a desired location. While holding on to a non-movable object for additional safety, person 280 steps on low-profile balance board 100 and begins applying an active use resistance and an active use effort to balance themselves and board 110 on the selected member. Person 280, while standing on board 110, can change positions of board 110 with respect to the selected member to target a particular muscle group.

Board 110 and member 140, 200, or 230 can be configured for multi-use purposes. Instead of using board 110 and member 140, 200, or 230 as a balance board, board 110 and member 140, 200, or 230 can be configured for use as a low-profile board for plank exercises and other upper extremity exercises. Plank exercises can help strengthen the core muscles that surround the spine, abdominal viscera, and hip, as well as strengthen the cervical, shoulder and thoracic regions. Plank exercises can also help improve balance and increase motor coordination for the entire body.

Board 110 can be manufactured using Baltic birch grade 3B plywood, a CNC (Computer Numerical Controlled) machining process, and a meticulous detailed sanding process. Board 110 can also include rubber edging 400 for protection and dampening of noise effect. Board 110 can include non-slip decals to the top and bottom surfaces of board 110 for safety and education purposes. Members 140, 200, and 230 can be cut from high-quality white oak and sanded for beveled fulcrum top and all edges sanded to avoid any sharp points. Decal stickers can be applied to member 140, 200, and 230 for identification and connection to board 110.

The above-disclosed embodiments have been presented for the purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure.

Clause 1, a balance board having dimensioned safety measures, the balance board comprising: a board having a top side for applying an active use resistance and an active use effort, a bottom side, and an outer circumference; a first member consisting of a base, a first side, a second side, and a pivot; a first pivot interface comprising a top section of the pivot and a first section of the bottom side of the board; and wherein the board comprises a traverse plane, the traverse plane having a fast, restricted roll and low-height profile.

Clause 2, the balance board of clause 1, wherein the first pivot interface comprises a surface, non-fixed contact.

Clause 3, the balance board of any of the preceding clauses, further comprising a second pivot interface, the second pivot interface comprising the top section of the pivot and a second section of the bottom side of the board, the second pivot interfaced achieved in response to movement (or swing or tipping) active resistance, movement (or swing or tipping) active effort, or both.

Clause 4, the balance board of any of the preceding clauses, wherein the pivot is rounded convex or bullnose shape.

Clause 5, the balance board of any of the preceding clauses, wherein the base comprises a first width and the pivot comprises a second width, the first width greater than the second width.

Clause 6, the balance board of any of the preceding clauses, further comprising a second member with two sides and a pivot, the second member having one or more dimensions different than the first member.

Clause 7, the balance board of any of the preceding clauses, further comprising one or more additional members with each having two sides and a pivot, the one or more additional members having one or more dimensions different than the first member and the second member.

Clause 8, an article of manufacture having dimensioned safety measures, the article of manufacture comprising: a board having a top side for applying an active use resistance and an active use effort, a bottom side, and an outer circumference; a plurality of members comprising: a first member consisting of a base, a first side, a second side, and a pivot between the first side and the second side; one or more additional members, wherein each additional members consists of: a base, a first side, a second side, and a pivot; wherein the base, the first side, the second side, the pivot, or any combination thereof of each additional member has one or more dimensions distinct from the first member and other additional members; a first pivot interface comprising a top section of the pivot and a first section of the bottom side of the board; and wherein the board comprises a traverse plane, the traverse plane having a fast, restricted roll and low-height profile.

Clause 9, the article of manufacture of any of the preceding clauses, wherein the first pivot interface comprises a surface, non-fixed contact.

Clause 10, the article of manufacture of any of the preceding clauses, further comprising a second pivot interface, the second pivot interface comprising the top section of the pivot and a second section of the bottom side of the board, the second pivot interfaced achieved in response to movement (or swing or tipping) active resistance, movement (or swing or tipping) active effort, or both.

Clause 11, the article of manufacture of any of the preceding clauses, wherein the pivot is rounded convex or bullnose shape.

Clause 12, the article of manufacture of any of the preceding clauses, wherein the base of each member comprises a first width and the pivot comprises a second width, the first width greater than the second width.

Clause 13, a balance board comprising: a board having a top side for applying an active use resistance and an active use effort, a bottom side, and an outer circumference; a first member consisting of a base, a first side, a second side, and a pivot between the first side and the second side, the base having a first width and the pivot having a second width, the first width greater than the second width; a first pivot interface comprising a roll section of the pivot and a first section of the bottom side of the board; and wherein the board and the first member have a low-height profile and a restricted roll in response to an active use resistance and an active use effort applied to the top side of the board.

Clause 14, the balance board of any of the preceding clauses, wherein the first pivot interface comprises a surface, non-fixed contact.

Clause 15, the balance board of any of the preceding clauses, further comprising a second pivot interface, the second pivot interface comprising the top section of the pivot and a second section of the bottom side of the board, the second pivot interfaced achieved in response to movement (or swing or tipping) active resistance, movement (or swing or tipping) active effort, or both.

Clause 16, the balance board of any of the preceding clauses, wherein the pivot is rounded convex or bullnose shape.

Clause 17, the balance board of any of the preceding clauses, wherein the base has a width 5 times greater than the width of the pivot's base.

Clause 18, the balance board of any of the preceding clauses, wherein a first side and the second side have an angle of incline of 45 degrees.

Clause 19, the balance board of any of the preceding clauses, further comprising a second member with two sides and a pivot, the second member having one or more dimensions different than the first member.

Clause 20, the balance board of any of the preceding clauses, further comprising one or more additional members with each having two sides and a pivot, the one or more additional members having one or more dimensions different than the first member and the second member.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A balance board having dimensioned safety measures, the balance board comprising:

a board having a top side for applying an active use resistance and an active use effort, a bottom side, and an outer circumference;

a first member consisting of a base, a first side, a second side, and a pivot;

a first pivot interface comprising a top section of the pivot and a first section of the bottom side of the board; and wherein the board comprises a traverse plane, the traverse plane having a fast, restricted roll and low-height profile; and a second member with two sides and a pivot, the second member having one or more dimensions different than the first member.

2. The balance board of claim 1, wherein the first pivot interface comprises a surface, non-fixed contact.

3. The balance board of claim 2, further comprising a second pivot interface, the second pivot interface comprising the top section of the pivot and a second section of the bottom side of the board, the second pivot interfaced achieved in response to rotational active resistance, rotational active effort, or both.

4. The balance board of claim 1, wherein the pivot is rounded convex or bullnose shape.

5. The balance board of claim 1, wherein the base comprises a first width and the pivot comprises a second width, the first width greater than the second width.

6. The balance board of claim 1, further comprising one or more additional members with each having two sides and a pivot, the one or more additional members having one or more dimensions different than the first member and the second member.

7. An article of manufacture having dimensioned safety measures, the article of manufacture comprising:

a board having a top side for applying an active use resistance and an active use effort, a bottom side, and an outer circumference;

a plurality of members comprising:

a first member consisting of a base, a first side, a second side, and a pivot between the first side and the second side;

one or more additional members, wherein each additional members consists of:

a base, a first side, a second side, and a pivot;

wherein the base, the first side, the second side, the pivot, or any combination thereof of each additional member has one or more dimensions distinct from the first member and other additional members;

a first pivot interface comprising a top section of the pivot and a first section of the bottom side of the board; and wherein the board comprises a traverse plane, the traverse plane having a fast, restricted roll and low-height profile.

8. The article of manufacture of claim 7, wherein the first pivot interface comprises a surface, non-fixed contact.

9. The article of manufacture of claim 8, further comprising a second pivot interface, the second pivot interface comprising the top section of the pivot and a second section of the bottom side of the board, the second pivot interfaced achieved in response to rotational active resistance, rotational active effort, or both.

10. The article of manufacture of claim 7, wherein the pivot is rounded convex or bullnose shape.

11. The article of manufacture of claim 7, wherein the base of each member comprises a first width and the pivot comprises a second width, the first width greater than the second width.

12. A balance board comprising:

a board having a top side for applying an active use resistance and an active use effort, a bottom side, and an outer circumference;

a first member consisting of a base, a first side, a second side, and a pivot between the first side and the second side, the base having a first width and the pivot having a second width, the first width greater than the second width;

a first pivot interface comprising a roll section of the pivot and a first section of the bottom side of the board; and wherein the board and the first member have a low-height profile and a restricted roll in response to an active use resistance and an active use effort applied to the top side of the board; and one or more additional members with each having two sides and a pivot, the one or more additional members having one or more dimensions different than the first member and a second member.

13. The balance board of claim 12, wherein the first pivot interface comprises a surface, non-fixed contact.

14. The balance board of claim 13, further comprising a second pivot interface, the second pivot interface comprising the top section of the pivot and a second section of the bottom side of the board, the second pivot interfaced achieved in response to movement or swing or tipping active resistance, movement or swing or tipping active effort, or both.

15. The balance board of claim 12, wherein the pivot is rounded convex or bullnose shape.

16. The balance board of claim 12, wherein the base has a width 5 times greater than that of a base of the pivot.

17. The balance board of claim 12, wherein the first side and the second side have an angle of incline of about 45 degrees.

18. The balance board of claim 12, further comprising the second member with two sides and a pivot, the second member having one or more dimensions different than the first member.

* * * * *